US011905670B2

(12) United States Patent
Margaritelli et al.

(10) Patent No.: US 11,905,670 B2
(45) Date of Patent: Feb. 20, 2024

(54) SAFETY END PIECE FOR ROAD BARRIERS

(71) Applicant: MARGARITELLI FERROVIARIA S.P.A., Perugia (IT)

(72) Inventors: Dario Margaritelli, Perugia (IT); Vittorio Giavotto, Milan (IT)

( * ) Notice: Subject to any disclaimer, the term of this patent is extended or adjusted under 35 U.S.C. 154(b) by 444 days.

(21) Appl. No.: 17/429,665

(22) PCT Filed: Jan. 13, 2020

(86) PCT No.: PCT/EP2020/050707
§ 371 (c)(1),
(2) Date: Aug. 10, 2021

(87) PCT Pub. No.: WO2020/173612
PCT Pub. Date: Sep. 3, 2020

(65) Prior Publication Data

US 2022/0213658 A1 Jul. 7, 2022

(30) Foreign Application Priority Data

Feb. 26, 2019 (IT) ..... 102019000002773

(51) Int. Cl.
*E01F 15/14* (2006.01)
*E01F 15/04* (2006.01)

(52) U.S. Cl.
CPC ..... *E01F 15/146* (2013.01); *E01F 15/0438* (2013.01); *E01F 15/0453* (2013.01)

(58) Field of Classification Search
CPC ..... E01F 15/146; E01F 15/0438; E01F 15/0453; E01F 15/04; E01F 15/0407; E01F 15/0423; E01F 15/143; E01F 15/145
See application file for complete search history.

(56) References Cited

U.S. PATENT DOCUMENTS 4,674,911 A * 6/1987 Gertz ..... E01F 15/146 267/116
5,169,127 A 12/1992 Eynard
5,172,891 A * 12/1992 Chen ..... E01F 15/0438 248/66
5,957,435 A 9/1999 Bronstad
(Continued)

FOREIGN PATENT DOCUMENTS

EP 1947244 A1 7/2008
GB 991522 A 5/1965

OTHER PUBLICATIONS

International Search Report for corresponding PCT/EP2020/050707, dated Feb. 4, 2020.
(Continued)

*Primary Examiner* — Abigail A Risic
(74) *Attorney, Agent, or Firm* — Egbert, McDaniel & Swartz, PLLC

(57) ABSTRACT

Safety end piece mounted in the front end of metal road barriers, wherein the end piece is frontally provided with a sliding support with blades that, when hit by an out of control vehicle, is capable of moving towards a beam of laminated wood and interfering with the blades with the structure of the beam, in such a way that the interference determines a progressive reduction of the forward traveling speed of the sliding support and absorbs the energy of the impact discharged by the out of control vehicle against the sliding support.

10 Claims, 7 Drawing Sheets

(56) References Cited

U.S. PATENT DOCUMENTS

| | | | | |
|---|---|---|---|---|
| 6,306,484 | B1 * | 10/2001 | Bove | B32B 3/10 52/DIG. 9 |
| 9,051,698 | B1 * | 6/2015 | Anghileri | E01F 15/146 |
| 9,145,943 | B2 * | 9/2015 | Sicking | E01F 15/145 |
| 9,714,493 | B1 * | 7/2017 | Dyke | E01F 15/143 |
| 2001/0014254 | A1 * | 8/2001 | Albritton | E01F 15/146 404/6 |
| 2002/0158241 | A1 | 10/2002 | Ochoa | |
| 2003/0077120 | A1 * | 4/2003 | Jonsson | E01F 15/02 404/6 |
| 2004/0086334 | A1 * | 5/2004 | Kamarata | E01F 15/0453 404/6 |
| 2005/0036832 | A1 * | 2/2005 | Smith | E01F 15/146 404/6 |
| 2011/0091273 | A1 * | 4/2011 | Sayre | C08G 18/3215 404/6 |
| 2017/0051461 | A1 * | 2/2017 | Alberson | E01F 15/025 |
| 2023/0265623 | A1 * | 8/2023 | Bennani Braouli | E01F 15/145 248/548 |

OTHER PUBLICATIONS

Written Opinion of the International Searching Authority for corresponding PCT/EP2020/050707, dated Feb. 4, 2020.

* cited by examiner

SAFETY END PIECE FOR ROAD BARRIERS

The present patent application for industrial invention relates to a safety end piece for road barriers.

The peculiarities and advantages of the present invention will be more evident after a short description of the prior art.

As it is known, a road barrier consists in a structure disposed along the edge of a road, with the purpose of retaining the vehicles that may deviate from the correct trajectory towards the exterior of the carriageway, without severe risks for the safety of the passengers.

The most typical and most popular road barriers are metal guardrails that are substantially formed of long bands made of heavy corrugated sheet iron that are horizontally supported by a suitable set of sturdy metal posts that are fixed to the ground.

The large popularity of these road barriers all over the world is the confirmation of their great efficacy.

In spite of the above, the road barriers of the prior art are impaired by a considerable drawback.

Reference is made to the fact that such road barriers involve a considerable risk for the safety of the vehicles and of the passengers when they are frontally hit in their initial end by an out of control vehicle.

In fact, in such a case, being disposed in edgewise position, the end of any road barrier tends to act on the vehicle as a blade, concentrating the impact on a small surface and having a very high penetrating force.

Evidently, such a dangerous effect is amplified because, after a similar shock, the vehicle is abruptly stopped against the road barrier, without the possibility of sliding in a guided way along the barrier and of progressively dissipating the energy of the impact.

In such a case, the occupants of the vehicle are likely to suffer severe traumas due to the sudden deceleration.

The specific purpose of the present invention is to devise a wood end piece with progressive impact absorption, which is suitable for being mounted at the ends of traditional road barriers.

Its function is to absorb and gradually dissipate, as if it were a sort of shock-absorber, the kinetic energy of a vehicle that hits the road barrier in axial direction because of an unexpected deviation from the correct traveling direction.

In order to achieve a similar function, the end piece of the invention substantially consists in a beam of laminated wood with horizontal direction that is fixed to the ground by means of a suitable column, in correspondence of its back end, and is supported for the remaining length by a number of sliding support means that are spaced regularly and are capable of sliding relative to a rectilinear guide fixed to the ground.

The additional part of said end piece consists in a slider suitable for sliding relative to the guide, which is mounted in the initial end of said beam and is consequently suitable for becoming the impact point when a vehicle deviates from its traveling direction and hits the end piece in axial direction.

In particular, said slider has a box body suitable for exactly containing the front end of said beam made of laminated wood; it being also provided that said box body is internally provided with a set of especially sharp blades that are directed towards the beam.

In such a situation, the impact caused by an out of control vehicle will determine the energetic forward movement of said slider towards the wooden beam, in such a way that its blades will progressively cut the structure of the beam along substantially longitudinal cutting lines, gradually slicing and chipping the beam.

Naturally, the wood of the beam will offer a significant resistance against the cutting action of said blades and against the thrust exerted by the out of control vehicle against said slider.

Such a resistance capacity that is guaranteed by the beam against the forward movement of the slider will generate the shock-absorbing effect that tends to progressively slow down the out of control vehicle until it is stopped.

It must be noted that, when the slider is moved forward because the impact with the vehicle, the slider is also capable of fulfilling two additional functions.

On one side, it will eject the splinters and the chips of wood that are gradually removed by the blades from the structure of said beam made of laminated wood.

On the other side, while the beam is chipped and its length is reduced, the slider will successively interfere with the various sliding support means that support the beam horizontally.

Because of such an interference, the various sliding support means are forced to slide forward along the guide, ultimately stopping one against the other and reducing the distance that initially existed between them, in proportion to the reduction of the length of the beam.

According to this first description, it can be easily understood the reason why the beam is made with laminated wood, it being a type of wood provided with a wood fiber that is substantially parallel to the longitudinal axis of the beam.

In view of the above, such a beam can be cut by the blades of the slider with a suitable resistance to generate the shock-absorbing effect that guarantees the desired progressive slowing down the vehicle after frontally hitting the slider.

For the sake of clarity, the description of the invention continues with reference to the attached drawings, which have a merely illustrative, not limiting value, wherein.

With reference to the appended figures, the end piece (T) consists in an apparatus formed of some cooperating parts.

The first part consists in a track (1) suitable for being fixed to the ground on the edge of a carriageway, in aligned position in front of an ordinary safety road barrier, possibly an ordinary guardrail.

In order to favor the firm fixing of the track (1) to the ground, the track (1) is provided in lower position with a set of posts (100) suitable for deeply penetrating the ground.

Figure 5:
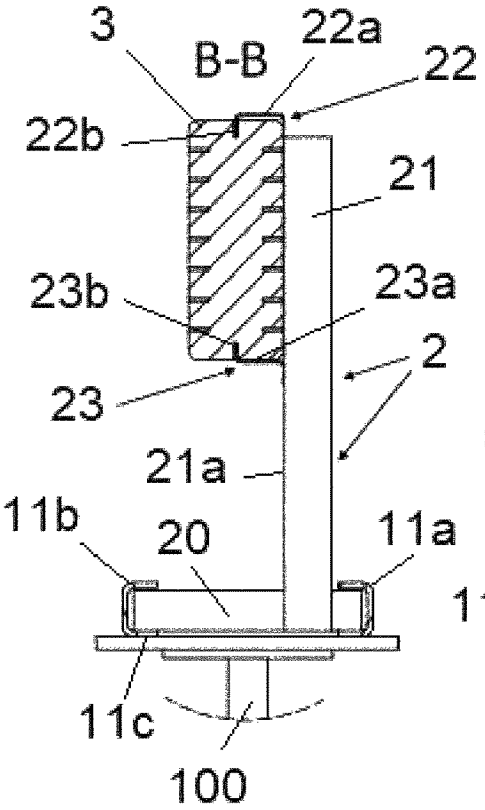
FIG. 5 is a sectional view of FIG. 4 with plane B-B.
Figure 4:
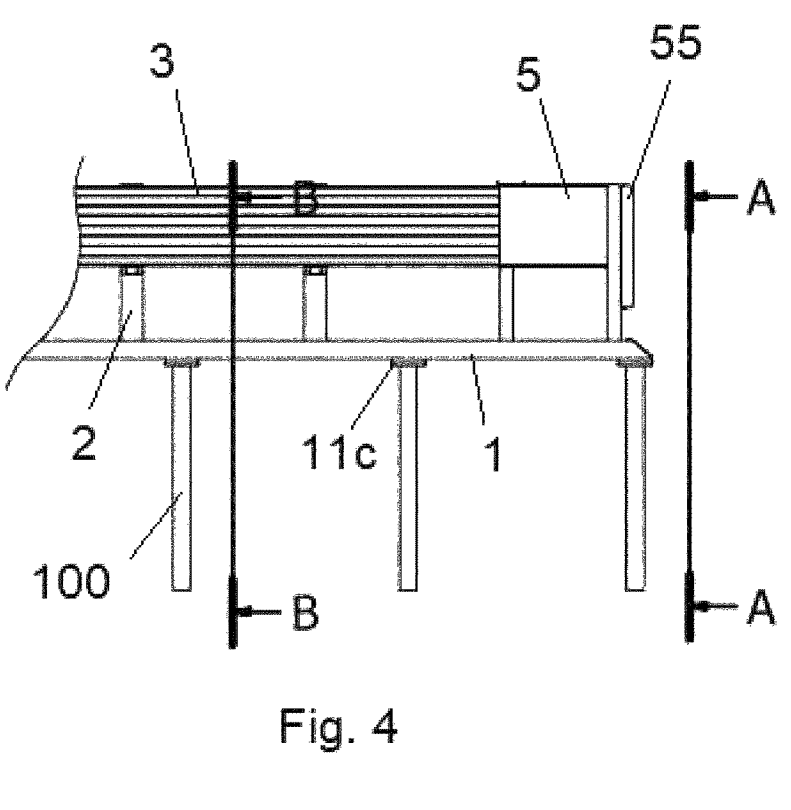
FIG. 4 is a side view of the front end of the end piece according to the invention.

With reference to FIG. 5, the track (1) is composed of a first C-shaped guide (11*a*) and a second C-shaped guide (11*b*) that are identical and parallel, with facing concavities.

Said two C-shaped guides (11*a*, 11*b*) are firmly fixed in parallel position by means of a set of crosspieces (11*c*); it being provided that each one of said crosspieces (11*c*) is also the fixing point of a post (100).

The second part of the end piece (T) according to the invention consists in a sliding support means (2) suitable for being used from time to time in the desired number of pieces, as expressly shown in FIG. 5.

Said sliding support means (2) is provided at the base with a slide (20) suitable for being transversely and exactly inserted between said two C-shaped guides (11*a*, 11*b*) of the track (1) with the possibility of freely sliding.

Said slide (20) is provided in upper position with an upright (21) disposed in off-centered position, and more precisely, protruding near the first one (11*a*) of the two C-shaped guides of the track (1).

Said upright (21) is provided on the internal side (21*a*)—i.e. the side facing the second C-shaped guide (11*b*) of the track (1)—with a pair of hooked brackets (22, 23) that are aligned vertically, but lie at different heights, provided with a substantially L-shaped profile in the portion that protrudes from said upright (21).

As a matter of fact, the upper bracket (22), which is fixed at the top of the upright (21), comprises a horizontal wing (21) joined at the end with a downward-facing vertical wing (22*b*).

The lower bracket (23), which is fixed under the upper bracket (22), comprises a horizontal wing (23*a*) joined at the end with an upward-facing vertical wing (22*b*), which is preferably suitable for being perfectly aligned with the vertical wing (22*b*) of the upper bracket (22).

It can be said that said two brackets (22, 23) are practically configured as a pair of tightening jaws.

Figure 7:
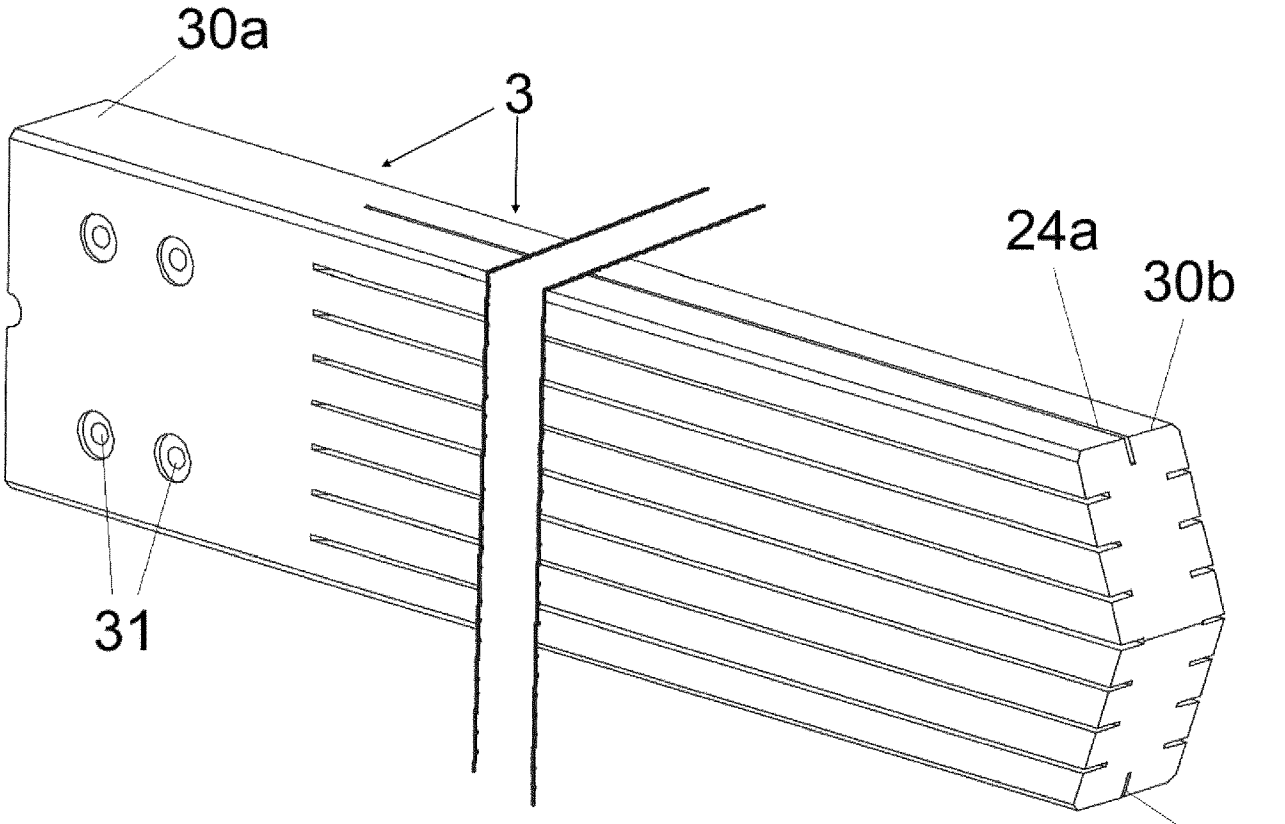
FIG. 7 is an axonometric view of the wooden beam provided in the end piece according to the invention.
Figure 7A:
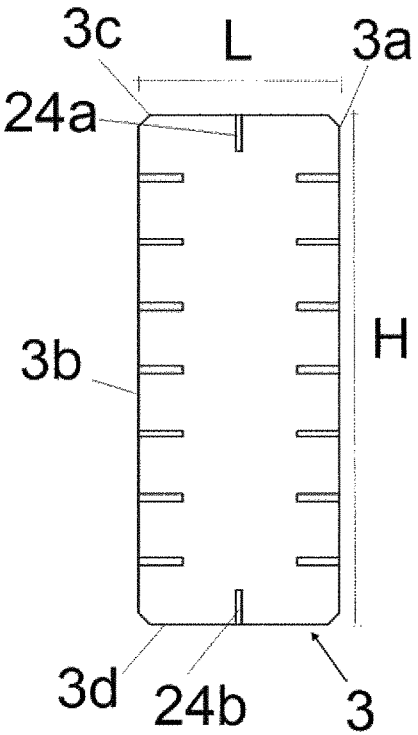
FIG. 7A is a sectional view of the beam of FIG. 7 with a vertical plane.

With reference to FIGS. 7 and 7A, the third part of the end piece according to the invention (T) consists in a beam (3) made of laminated wood suitable for being supported in horizontal position by a suitable number of said sliding support means (2) that are slidingly inserted in said track (1).

Said beam (3) has a rectangular section that is developed vertically, being defined by a first vertical wall (3*a*), a second vertical wall (3*b*), an upper horizontal wall (3*c*) and a lower horizontal wall (3*d*); and being also provided that the upper horizontal wall (3*c*) and the lower horizontal wall (3*d*) are provided with central longitudinal grooves (24*a*, 24*b*).

Within such a configuration, the beam (3) has a height (H) that is substantially identical to the vertical distance that is established between the horizontal wing (22*a*) of said upper bracket (22) and the horizontal wing (23*a*) of the lower bracket (23), and a width (L) that is substantially double than the horizontal distance that is established between each one of said vertical wings (22*b*, 23*b*) of the two brackets (22, 23) and the upright (21).

In view of the above, as shown in FIG. 5, the beam (3) can be firmly engaged between said horizontal wings (22*a*, 23*a*) of the two brackets (22, 23), in such a way that the first vertical wall (3*a*) is engaged against said internal side (21*a*) of the upright (21), whereas said vertical wings (22*b*, 23*b*) of the brackets (22, 23) are exactly engaged inside the longitudinal grooves (24*a*, 24*b*) provided in central position in the upper horizontal wall (3*c*) and in central position in the lower horizontal wall (3*d*) of the beam (3).

In such a way, the beam (3) is held in projecting position relative to the upright (21) of the slide supporting means (2), in the central line of the slide (20) of the sliding support means (2).

Figures 1, 1A:
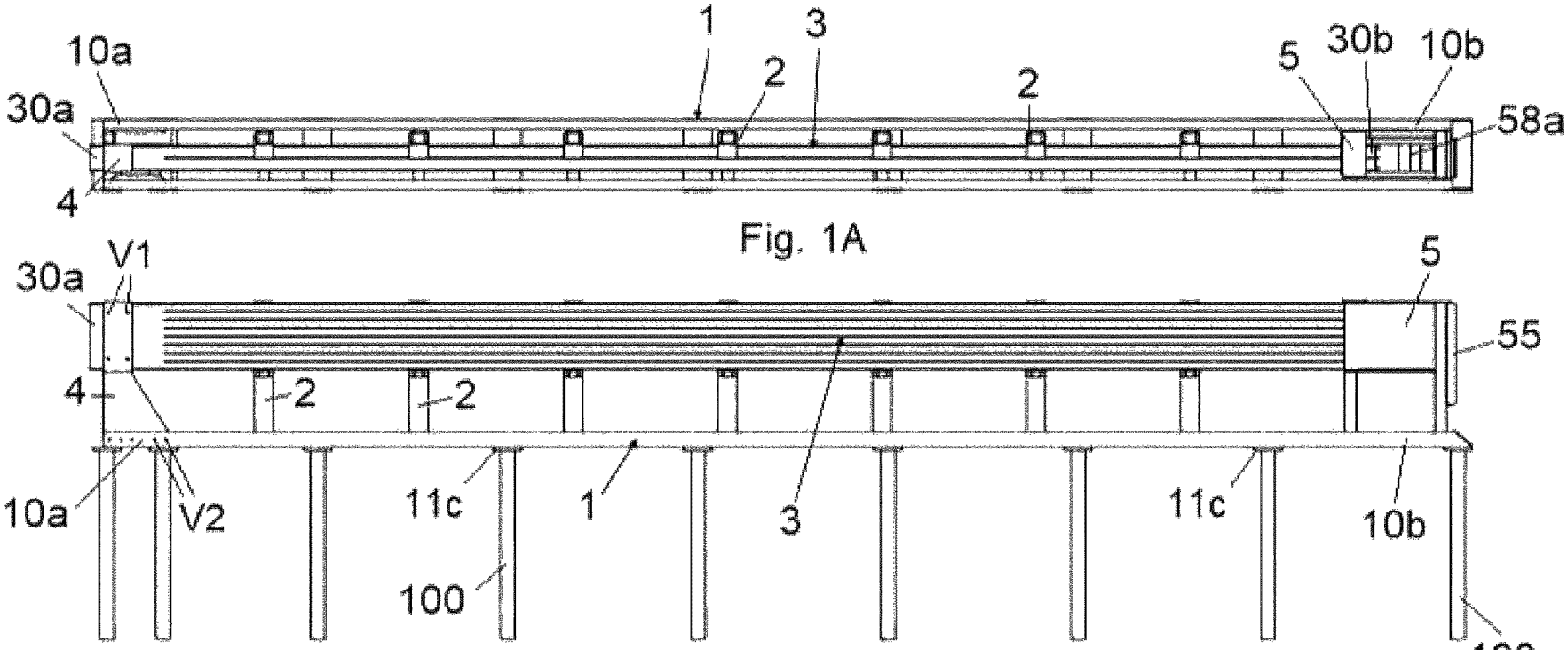
FIG. 1 is a side view of the end piece according to the invention, during its first installation.
FIG. 1A is a top view of FIG. 1.

With reference to FIG. 1A, it must be noted that the beam (3) has a lower length than the track (1) fixed to the ground.

Because of such a condition, in the initial operating position of the beam (3), the back end (30*a*) of the beam (3) is rigidly fixed in the back end (10*a*) of the track (1), whereas its front end (30*b*) is disposed in a considerably more internal position relative to the front end (10*b*) of the track (1).

Figure 8:
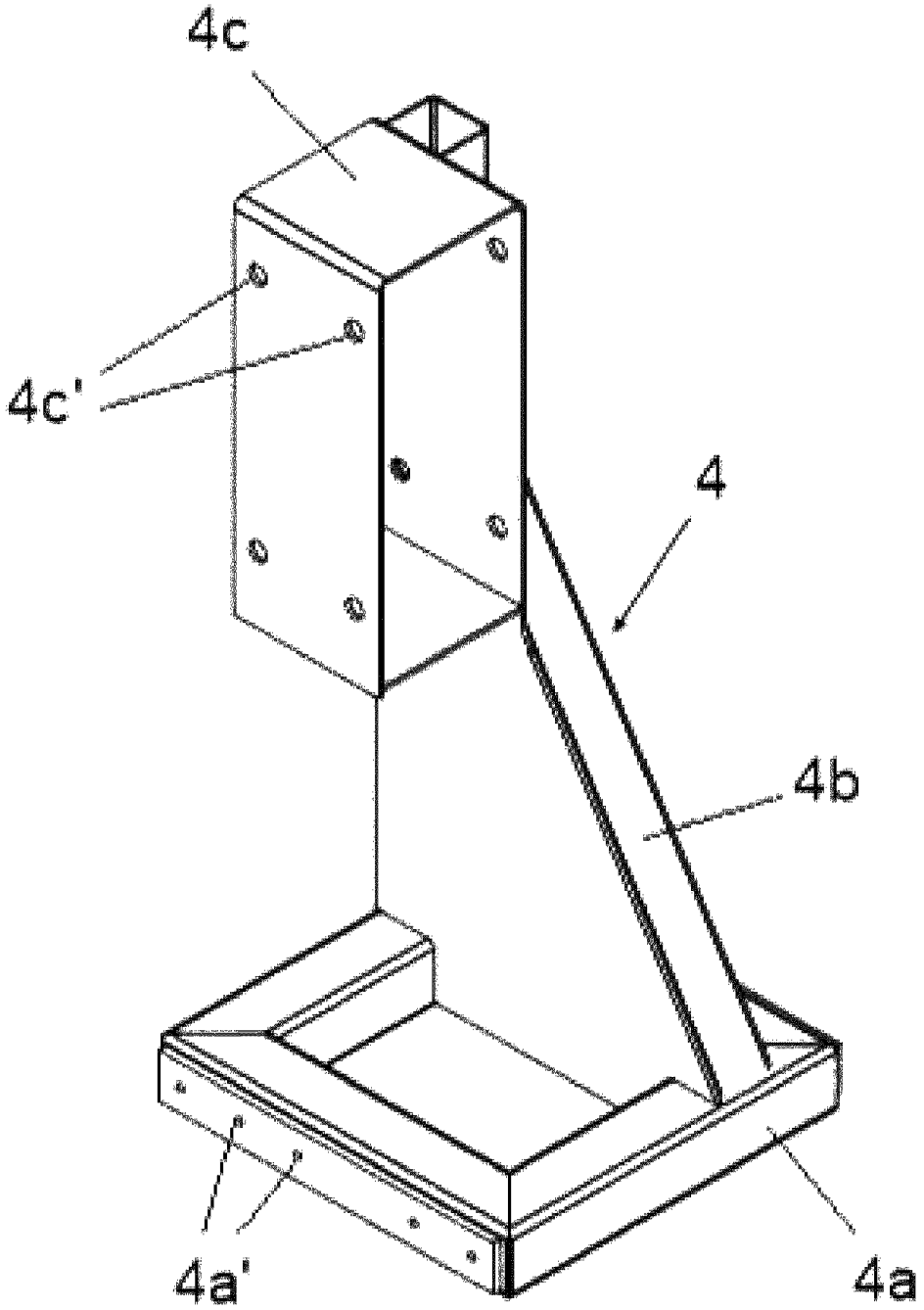
FIG. 8 is an axonometric view of the column used for supporting and fixing said beam of FIG. 7.

With reference to FIG. 8, the fourth part of the end section (T) consists in a column (4) suitable for fixing said first end (30*a*) of the beam (3) at the height of the first end (10*a*) of the track (1).

Said column (4) is suitably provided with a base plate (4*a*), with a substantially rectangular shape, suitable for being inserted and firmly screwed between said two C-shaped guides (11*a*, 11*b*) of the track (1) in said back end (10*a*) of the track (1).

A box vertical arm (4*b*) protrudes in upper position from said plate (4*a*) in off-centered position relative to said plate (4*a*), it lying in the proximity of the first one (11*a*) of said first C-shaped guide (11*a*) of the track (1).

In view of the above, in the operating position of the end piece (T) of the invention, the vertical arm (4*b*) is perfectly aligned with said uprights (21) provided in the sliding support means (2).

The function of said vertical arm (4*b*) is to support a rectangular sleeve (4*c*) in projecting position, substantially in correspondence of the central line of the plate (4*a*), said rectangular sleeve (4*c*) being suitable for exactly receiving said first end (30*a*) of the beam (3).

In particular, such a sleeve (4*c*) is disposed in such a way to be perfectly aligned with the pairs of said hooked brackets (22, 23) provided in the sliding support means (2), being suitable for supporting the intermediate points of the beam (3).

As shown in FIG. 8, holes with horizontal axis (4*c*') are obtained in the opposite vertical walls of said sleeve (4*c*), and holes with horizontal axis (4*a*') are obtained in the longitudinal edges of said plate (4*a*).

With reference to FIG. 1, the holes (4*c*') provided on the sleeve (4*c*) are suitable for receiving screws with horizontal axis (V1) suitable for engaging into corresponding holes (31) obtained in the back end (30*a*) of the beam (3) for firmly fixing the beam (3) inside the sleeve (4*c*).

The holes (4*a*') provided on the longitudinal edges of the plate (4) are suitable for receiving screws with horizontal axis (V2) inserted in holes with horizontal axis obtained on the two C-shaped guides (11*a*, 11*b*) of the track (1) and suitable for firmly fixing said plate (4) inside said back end (10*a*) of the track (1).

With reference to FIGS. 9A to 10B, the fifth part of the end piece of the invention (T) consists in a slider (5) suitable for being mounted in said front end (10*b*) of the track (1), in such a way to be exactly interfaced and cooperate with the front end (30*b*) of the beam (3), as illustrated below.

The slider (5) has a base frame (50) with rectangular shape, formed of two transverse sections (50*a*, 50*b*) connected at right angle by two longitudinal sections (50*c*, 50*d*); it being provided that the two transverse sections (50*a*, 50*b*) are suitable for being exactly inserted between the two C-shaped guides (11*a*, 11*b*) of the track (1) with possibility of sliding freely.

A framework (IN) is provided above the base frame (50) and formed of four vertical rods (50*a*', 50*a*", 50*b*', 50*b*") that substantially protrude upwards from the four corners of said frame (50) to support a box body (CS) with horizontal development in upper position, which is suitable for exactly housing the front end (30*b*) of the beam (3) in the non-operating position.

More precisely, a first vertical rod (50*a*') and a second vertical rod (50*a*") protrude from the two ends of the first transverse section (50*a*), said vertical rods (50*a*', 50*a*") being identical and externally fixed, at least on top, to a vertical panel (55) that practically is the front surface of the slider (5).

A third vertical rod (50*b*"), with the same height as the two rods (50*a*', 50*a*") of the first transverse section (50*a*), and a fourth vertical rod (50*b*'), with a substantially halved height, respectively protrude from the two ends of the second transverse section (50*b*), said fourth vertical rod (50*b*') being joined and fixed to the third vertical rod (50*b*") by means of a crossbar (50*b*'").

The box body (CS) is formed of a first side (56*a*) and a second side (56*b*) disposed in opposite position, wherein the first side (56*a*) is fixed between said first vertical rod (50*a*') and fourth vertical rod (50*b*') of the framework (IN), whereas the second side (56*b*) is fixed between said second vertical rod (50*a*") and said third vertical rod (50*b*").

Said box body (CS) is frontally covered by said panel (55), whereas is provided in the back with a mouth (57) that extends vertically between said two sides (56*a*, 56*b*); it being provided that the width of said mouth (57)—just like the center distance between the two sides (56*a*, 56*b*)—is slightly higher than said width (L) of the beam (3) and the height of said mouth (57) is slightly higher than said height (H) of the beam (3).

It must be noted that two sets of blades (58*a*, 58*b*) are fixed between said sides (56*a*, 57*a*) of said box body (CS), of which the upper set (58*a*) is curved upwards, towards the upper opening (59*a*) provided between said two sides (56*a*, 57*a*), whereas the lower set (58*b*) is curved downwards, towards the lower opening (59*b*) provided between the sides (56*a*, 57*a*).

The points of said blades (58*a*, 58*b*) are disposed in slightly backward position relative to said mouth (57) of the box body (CS); it being provided that the free space that is generated immediately behind the mouth (57) is suitable for housing said front end (30*b*) of the beam (3), in the non-operating position of the slider (5), as shown in FIG. 1A.

Moreover, it must be noted that said box body (CS) is positioned in said vertical framework (IN) in such a way to be horizontally aligned with the pairs of brackets (22, 23) provided in said sliding support means (2) and with the sleeve (4*c*) of said column (4), when the slider (5) is inserted in the track (1), because all these parts are suitable for cooperating with the same horizontal beam (3).

After illustrating the structure of the end piece of the invention (T), this description continues by illustrating its operating mode.

FIG. 1 shows the end piece (T) of the invention in its initial non-operating position.

In such a position, the following conditions are given:

- the back end (30*a*) of the beam (3) is inserted and firmly fixed inside the sleeve (4*c*) of the column (4) screwed to said back end (10*a*) of the track (1)
- the intermediate points of the beam (3)—which are comprised between the first end (30*a*) and the second end (30*b*) of the beam (3)—are tightened and supported by said pairs of hooked brackets (22, 23) of sliding support means (2) inserted in the track (1); it being preferably provided that said sliding support means (2) are regularly spaced
- the front end (30*b*) of the beam (3) is exactly inserted in said mouth (57) of the box body (CS) provided in the slider (5) already inserted in the track (1), in such a condition that said slider (5) is stopped in correspondence of said front end (10*b*) of the track (1) and is maintained at a distance from the sliding support means (2) in immediately adjacent position.

Figure 2:
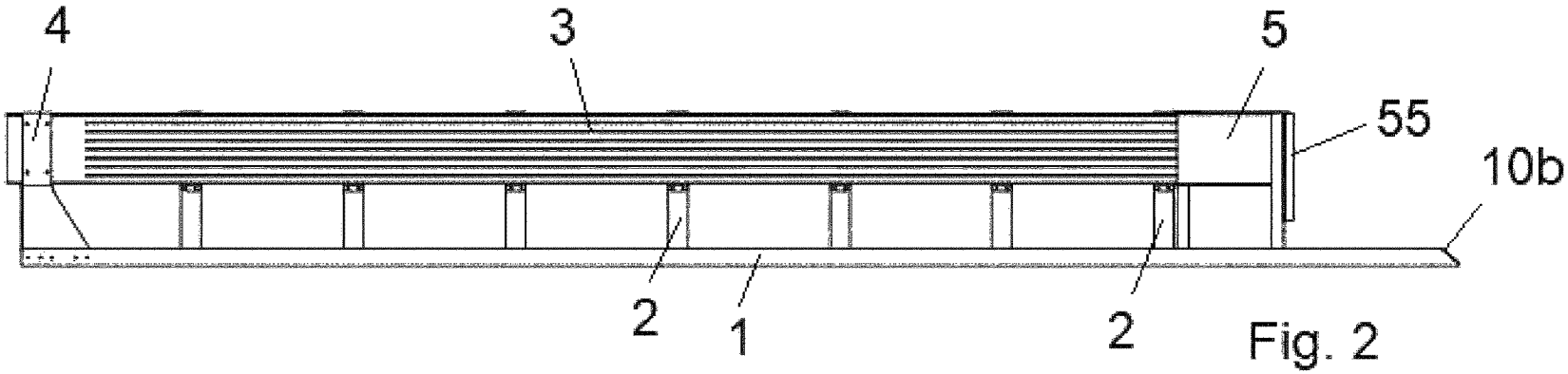
FIG. 2 is the same as FIG. 1, except for the fact that the end piece is shown in the position that is taken immediately after the impact with an out of control vehicle.

FIG. 2 illustrates the position of the end piece (T) according to the invention after the first effect of an impact of an out of control vehicle against the slider (5) and, more precisely, against its front panel (55).

Figure 10A:
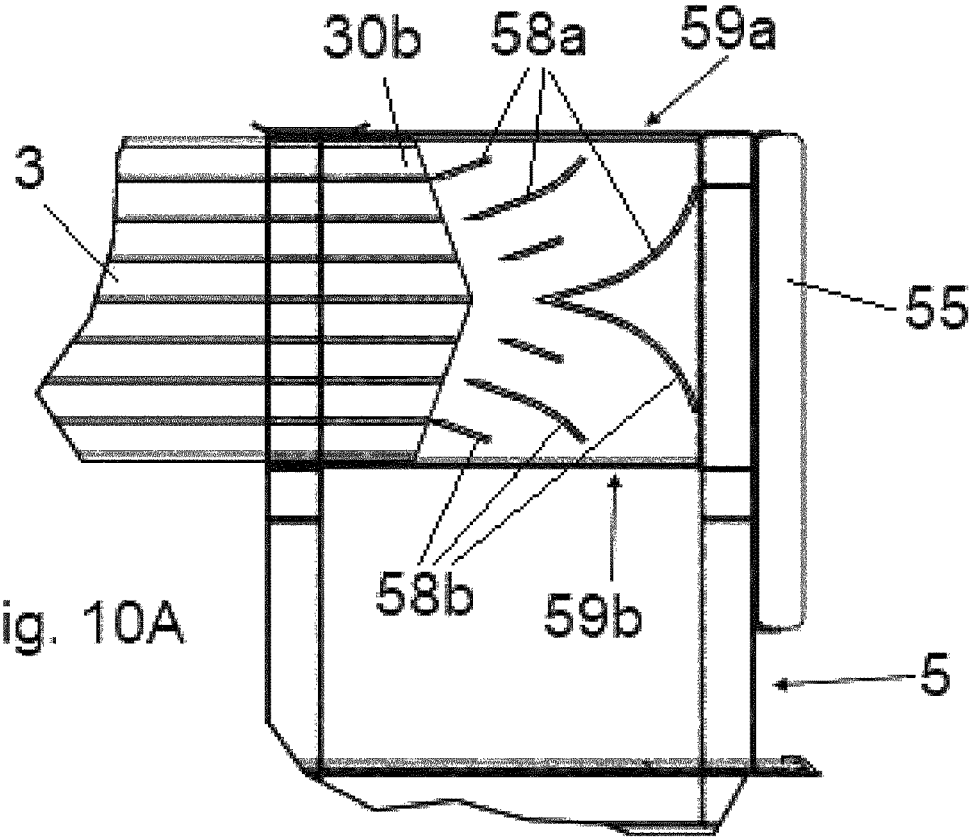
FIG. 10A is a sectional diagrammatic view of the position of the blades of said slider, relative to the beam, in the non-operating position.
Figure 10B:
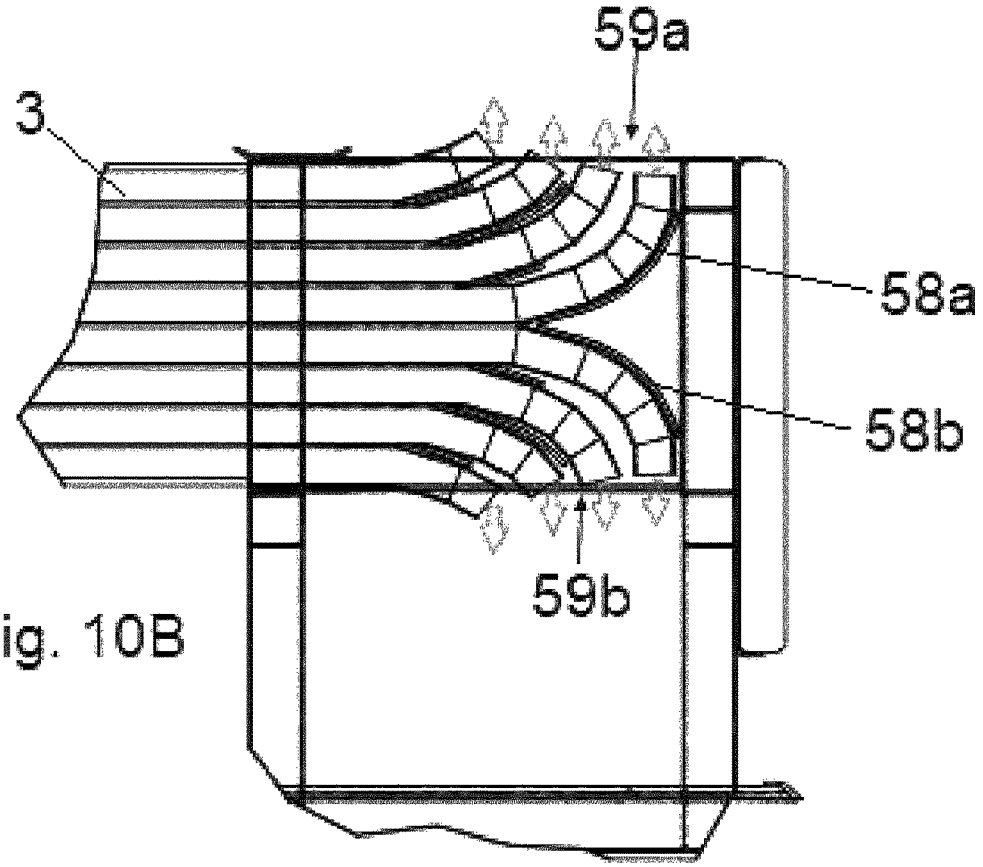
FIG. 10B is the same as the preceding figure, except for the fact that it shows the interference of the blades of the slider against the structure of the beam as a consequence of a forward thrust imposed to the slider.

In such a case, the slider (5) is energetically pushed forward along the track (1), in such a condition that:

- said curved blades (58*a*, 58*b*) of the box body (CS) of said slider (5) start to cut the structure of the beam (3); it being also provided that, because of the diverging curvature, the blades act as deflectors, capable of conveying the chips towards said two upper opening (59*a*) and lower opening (59*b*) of the box body (CS), as expressly shown in FIG. 10B;
- the slider (5) is stopped against the sliding support means (2) that was initially the closest one the slider (5), transmitting the thrust discharged by the out of control vehicle to said sliding support means (2) in a sort of domino effect, thus making the sliding support means (2) slide forward along the track (1).

Figure 3:
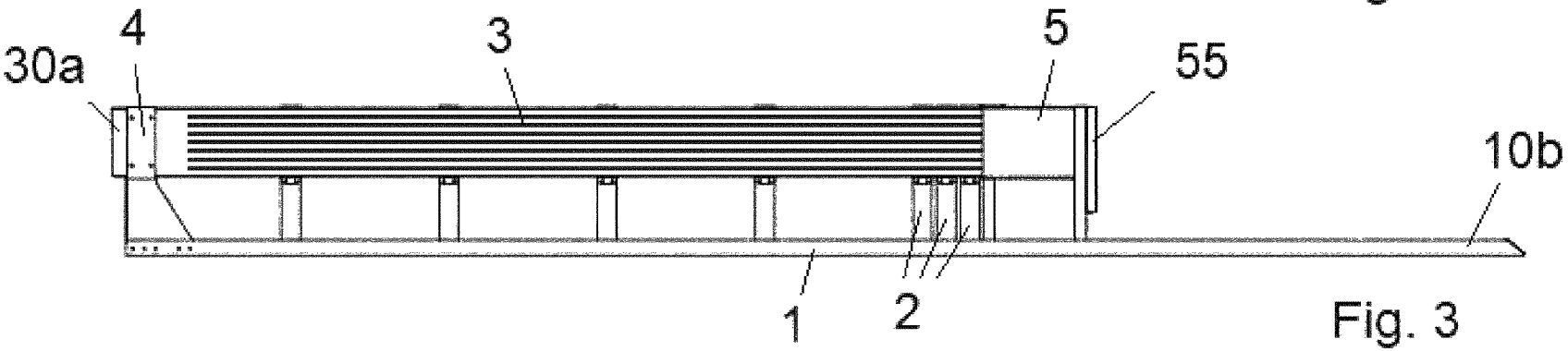
FIG. 3 is the same as FIG. 2, except for the fact that it shows the additional consequences produced on said end piece by the impact of the out of control vehicle.
Figure 6:
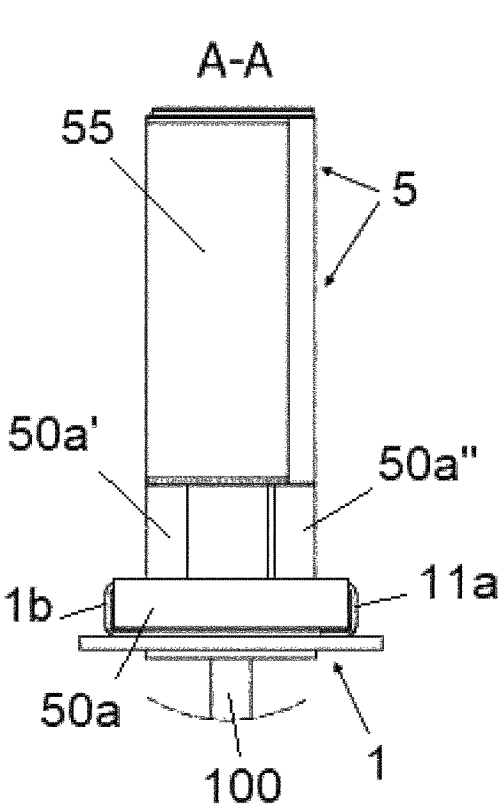
FIG. 6 is a sectional view of FIG. 4 with plane A-A.

FIG. 3 illustrates the results of said impact caused by an out of control vehicle on the slider (5), and more precisely shows that the progressive forward movement of said slider (5) along the track (1), consequently with a deeper and deeper cutting action of the blades (58*a*, 58*b*) on the beam (39, determines the forward sliding movement of a higher number of sliding support means (2), which are practically crammed along the track (1) during the progressive "consumption" of the beam (3).

The combined observation of FIG. 3 and FIG. 10B shows that the "traumatic" interference between the slider (5) and the beam (3) or, more precisely, between the blades (58*a*, 58*b*) of the slider (5) and the wood of the beam (3), guarantees the advantageous absorption of the impact caused on the slider (5) by an out of control vehicle.

Evidently, the energy of such an impact is progressively dissipated because of the longitudinal chipping of the hard structure of the beam (3) by the blades (58*a*, 58*b*) until the forward traveling speed of the slider (5) along the track (1)—just like the kinetic energy of the out of control vehicle that continues to interfere with the slider (5)—is progressively decreased and completely eliminated.

Figure 9C:
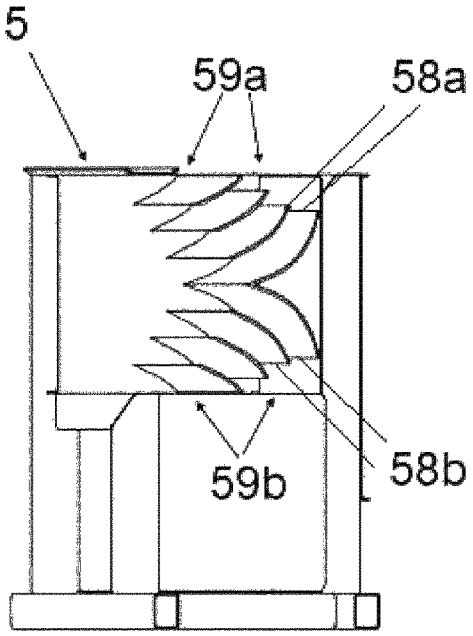
FIG. 9C is a sectional view with a median vertical plane of the slider of FIG. 9A.
Figure 9A:
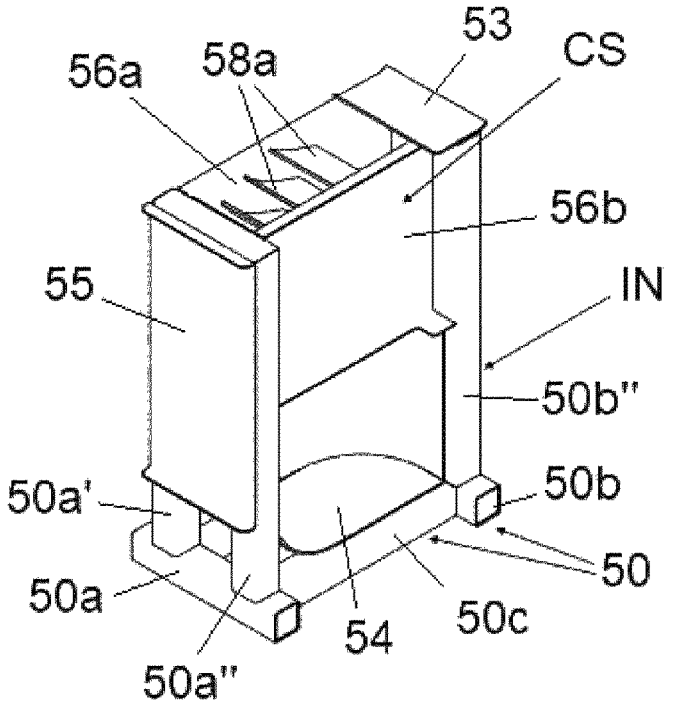
FIGS. 9A and 9B are two axonometric views that show from opposite sides the slider provided in the end piece according to the invention.
Figure 9B:
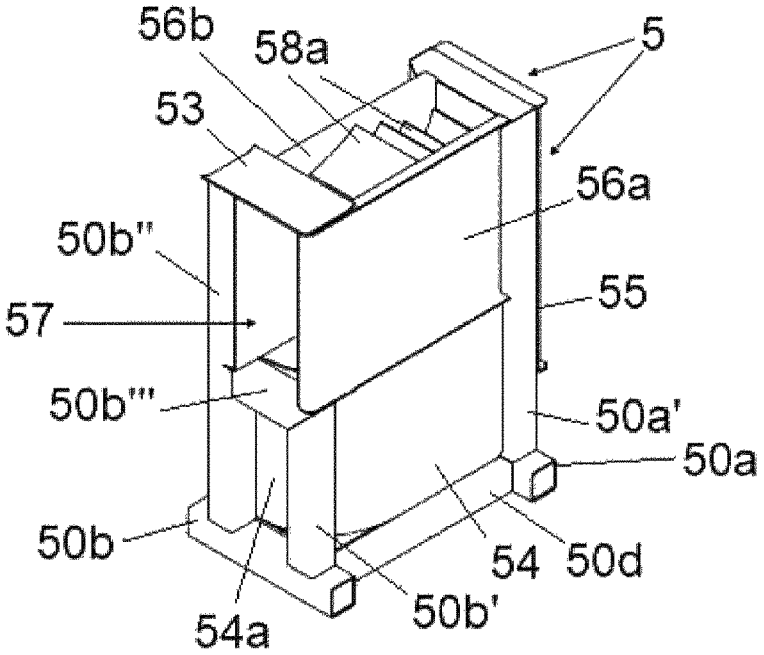

With reference to FIGS. 9A and 9B, it must be finally noted that said slider (5) is provided, under said box body (CS) and for its entire length, with a longitudinal partition (54) that is provided, in a position comprised between said third and fourth vertical rod (50*b*', 50*b*") of said framework (IN), with a convex vertical edge (54*a*) directed towards the first side (56*a*) of the box body (CS).

Because of its curvature, said partition (54) practically acts as deflector, it being capable of favoring the ejection towards one side of the slider (5) of the wooden chips produced by the blades (58*a*, 58*b*) that may be intercepted by the slider (5) during its forward travel along the track (1) and may otherwise interfere with the correct forward travel.

A sloping wing (53) is transversally mounted, immediately above said mouth (57) of the box body (CS), it being suitable for conveying upwards—and more precisely towards said upper opening (59*a*) of the box body (CS)—the wood chips that may be intercepted by the slider (5) while sliding along the track (1).

The invention claimed is:

1. Safety end piece for road barriers, comprising:

a beam made of laminated wood, provided with a back end and a front end and supported in horizontal position above a track provided with a back end and a front end by means of a fixed supporting means associated with said back end of the track and a plurality of sliding support means along said track, which are capable of tightening points of the beam comprised between said back end and front end of the beam; and a slider suitable for being inserted in said front end of the track, with the possibility of sliding freely, and provided with a box body with a mouth suitable for exactly receiving said front end of the beam; wherein said box body is internally provided with a plurality of blades disposed behind said mouth, said blades being suitable for longitudinally cutting the beam, progressively reducing its length, when said slider is submitted to a force capable of moving it forward towards said back end of the track; wherein, during the forward movement, said slider progressively interferes with said sliding support means of the beam, forcing said sliding support means to move towards the back end of the track.

2. The end piece of claim 1, wherein said track is composed of a first "C"-shaped guide and a second "C"-shaped guide that are identical and parallel, with facing concavities and fixed above a set of crosspieces; wherein each of said crosspieces is also the fixing point of a post suitable for penetrating into the ground.

3. The end piece of claim 1, wherein said beam of laminated wood is provided with a rectangular section that is developed vertically and defined by a first vertical wall, a second vertical wall, an upper horizontal wall and a lower horizontal wall; and wherein said upper horizontal wall and said lower horizontal wall of said beam are cut by central longitudinal grooves.

4. The end piece of claim 1, wherein said fixed support means of the beam consists of a column comprising:

a base plate suitable for being inserted and fixed between said first "C"-shaped guide and said second "C"-shaped guide of the track in said back end of the track; and an arm that protrudes vertically from said plate, and is suitable for supporting a sleeve in projecting position towards said first "C"-shaped guide of the track and substantially in the center of said plate, said sleeve being suitable for exactly and firmly receiving said back end of the beam.

5. The end piece of claim 4, wherein said sleeve of the column is provided on its vertical walls with through holes for the insertion of screws with a horizontal axis suitable for being successively engaged into corresponding holes obtained in said back end of the beam.

6. The end piece of claim 1, wherein said plate is provided on its longitudinal edges with holes with horizontal axis suitable for receiving screws with horizontal axis that are previously inserted into corresponding holes obtained on said first "C"-shaped guide and said second "C"-shaped guide at the height of the back end of the track.

7. The end piece of claim 1, wherein each of said sliding support means of the beam consists of a sliding support means comprising:

a slide suitable for being slidingly inserted between said first "C"-shaped guide and said second "C"-shaped guide of the track, an upright that projects in off-centered position from said slide near the first one of the two "C"-shaped guides of the track, and a pair of hooked brackets that protrude at different heights from said upright towards the second one of said two "C"-shaped guides of the track, substantially on the central line of said slide; wherein the upper bracket comprises a horizontal wing joined at the end with a downward-facing vertical wing and wherein the lower bracket comprises a horizontal wing joined at the end with an upward-facing vertical wing in perfect alignment with said vertical wing of said upper bracket; wherein said horizontal wings of said brackets are suitable for exactly interfering against said upper horizontal wall and said lower horizontal wall of the beam, in such a way that said vertical wings are inserted in said longitudinal grooves respectively provided in said upper horizontal wall and said lower horizontal wall of the beam.

8. The end piece of claim 1, wherein said slider comprises:

a base frame suitable for being slidingly inserted between said first "C"-shaped guide and said second "C"-shaped guide of the track;

a framework that protrudes vertically from said base frame; said box body is supported in horizontal position at the top of said vertical frame and is formed of two sides that are frontally covered by a panel and provided in the back with said mouth suitable for exactly receiving said front end of the beam, wherein said box body is provided with an upper opening and a lower opening in intermediate position between said two sides; and an upper set of blades and a lower set of blades fixed between said two sides of said box body behind said mouth and therefore suitable for interfering with said beam when said slider starts its travel towards said back end of the track, making a longitudinal cut in the wooden structure; wherein said upper set of blades is curved upwards, towards said upper opening of the box body, whereas said lower set of blades is curved downwards, towards said lower opening of the box body.

9. The end piece of claim 8, wherein said base frame of the slider comprises a first transverse section and a second transverse section joined at right angle by two longitudinal sections, and wherein said frame of the slider comprises four vertical rods that project from the four corners of said base frame, wherein:

the first vertical rod and the second vertical rod have the same height and protrude from said first transverse section of the base frame, being also suitable for supporting said panel;

the third vertical rod and the fourth vertical rod protrude from said second transverse section of the base frame; wherein the third rod has the same height as said first rod and said second rod, whereas the fourth rod has a substantially halved height and is joined and fixed to the third rod by means of a crossbar;

and wherein the first vertical rod and the fourth vertical rod support said first side of the box body of the slider, whereas the second vertical rod and the third vertical rod support said second side of said box body, in such a way that said third vertical rod and said fourth vertical rod are disposed on the sides of said mouth of the box body.

10. The end piece of claim 1, wherein said framework of the slider supports a longitudinal partition under said box body, said longitudinal partition having a convex vertical edge directed towards the first side of the box body, in a position comprised between said third vertical rod and said fourth vertical rod; and wherein said box body has a transverse wing with sloping profile disposed in upper position above said mouth.

* * * * *